US005440837A

United States Patent [19]

Piltingsrud

[11] Patent Number: 5,440,837

[45] Date of Patent: Aug. 15, 1995

[54] MANUALLY OPERABLE SASH LIFT FOR MOTORIZED DOUBLE HUNG WINDOW

[75] Inventor: Stephen M. Piltingsrud, Owatonna, Minn.

[73] Assignee: Truth Hardware Corporation, Owatonna, Minn.

[21] Appl. No.: 214,792

[22] Filed: Mar. 17, 1994

[51] Int. Cl.[6] ..... E05F 15/00

[52] U.S. Cl. ..... 49/139; 49/360; 74/625

[58] Field of Search ..... 49/139, 140, 360; 74/625, 89.21

[56] References Cited

U.S. PATENT DOCUMENTS

| | | | |
|---|---|---|---|
| 27,119 | 2/1860 | Fay et al. . | |
| Re. 34,230 | 4/1993 | Tucker et al. . | |
| 1,471,736 | 10/1923 | Johnson . | |
| 1,640,459 | 8/1927 | Lee . | |
| 1,724,011 | 8/1929 | Flagg . | |
| 1,748,662 | 2/1930 | Stewart . | |
| 2,036,151 | 3/1936 | Lang . | |
| 2,114,645 | 4/1938 | Van Eenschoten . | |
| 2,136,813 | 11/1938 | Carnahan . | |
| 2,157,016 | 5/1939 | Reynaud . | |
| 2,256,613 | 9/1941 | Forman et al. . | |
| 2,366,613 | 1/1945 | Hagstrom . | |
| 2,449,761 | 9/1948 | Bemis . | |
| 2,538,980 | 1/1951 | Payne, Jr. . | |
| 2,905,464 | 9/1959 | Shaw, Sr. . | |
| 3,145,988 | 8/1964 | Colautti et al. . | |
| 3,154,302 | 10/1964 | Maruyama . | |
| 3,202,414 | 8/1965 | Simmons et al. . | |
| 3,257,755 | 6/1966 | Lewis . | |
| 3,274,732 | 9/1966 | Murakami . | |
| 3,403,474 | 10/1968 | Spasoff | 49/139 |
| 3,512,302 | 5/1970 | Sivin et al. | 49/139 |
| 3,653,154 | 4/1972 | Hayday . | |
| 4,241,541 | 12/1980 | Van Klompenburg et al. . | |

FOREIGN PATENT DOCUMENTS

| | | | |
|---|---|---|---|
| 0323241 | 7/1989 | European Pat. Off. . | |
| 653755 | 12/1937 | Germany . | |
| 1176021 | 8/1964 | Germany . | |
| 2601342 | 1/1977 | Germany . | |
| 43872 | of 1960 | Poland . | |
| 2227280 | 7/1990 | United Kingdom | 49/360 |

(List continued on next page.)

*Primary Examiner*—Peter M. Cuomo
*Assistant Examiner*—Jerry Redman
*Attorney, Agent, or Firm*—Wood, Phillips, VanSanten, Clark & Mortimer

[57] ABSTRACT

An apparatus for both manual and powered operation of the sash of a double hung window, including a drive belt adjacent one side of the sash, a power drive for the belt, and a pulley carried with the sash and engaging the belt. Two ratchets having wheels with oppositely facing inclined teeth and pawls biased into engagement with the wheel of the respective ratchet through a connecting shaft secure the pulley against pivoting in either direction to effectively lock the pulley relative to the engaged belt. A ratchet housing is disposed in a sash recess and has a D-shaped opening on one end adjacent a cylindrical opening to the pulley. A bushing for the ratchet shaft is received in the sash cylindrical opening and includes a D-shaped flange receivable through an annular opening in the housing whereby twisting of the bushing misaligns the flange with a suitable tab to secure the bushing in the sash cylindrical opening. A manually graspable sash lift extends into the housing and when manually biased is movable a limited amount relative to the sash whereby the pawl of the ratchet which secures the pulley against pivoting in the direction required to allow the sash to move relative to the belt in the direction of the manual bias is disengaged from the ratchet wheel. The sash lift is also manually engageable to laterally move the shaft out of engagement with the pulley so as to permit the sash to be disconnected from the pulley for maintenance.

42 Claims, 2 Drawing Sheets

U.S. PATENT DOCUMENTS 4,253,276 3/1981 Peterson et al. .
4,266,371 5/1981 Erdman et al. .
4,305,228 12/1981 Nelson .
4,333,269 6/1982 Bascou .
4,392,330 7/1983 Buhr .
4,497,135 2/1985 Vetter .
4,541,202 9/1985 Dockery ..... 49/139 X
4,617,758 10/1986 Vetter .
4,679,352 7/1987 Bates .
4,823,508 4/1989 Allen .
4,840,075 6/1989 Tucker .
4,845,830 7/1989 Nolte et al. .
4,860,493 8/1989 Lense .
4,893,435 1/1990 Shalit ..... 49/139 X
4,937,976 7/1990 Tucker et al. .
5,144,770 9/1992 Kraus et al. ..... 49/360
5,152,103 10/1992 Tucker et al. .
5,199,216 4/1993 Vetter et al. .
5,271,183 12/1993 Hahn et al. ..... 49/360
5,272,837 12/1993 Nolte et al. .

Fig. 1
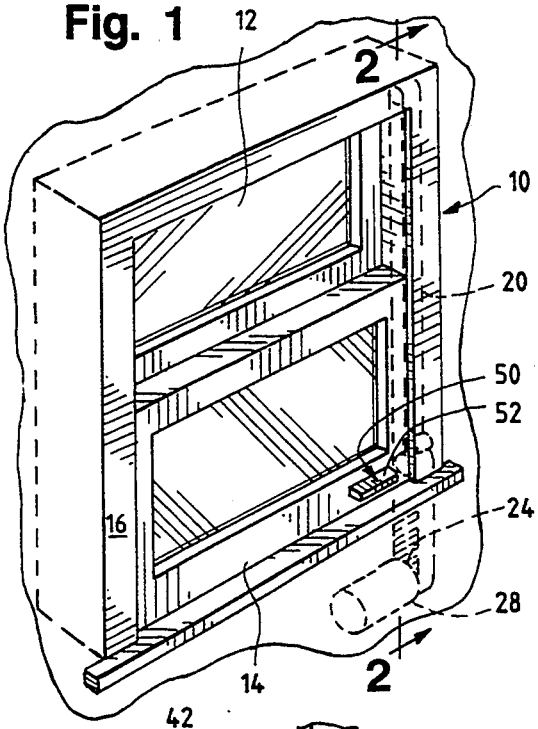
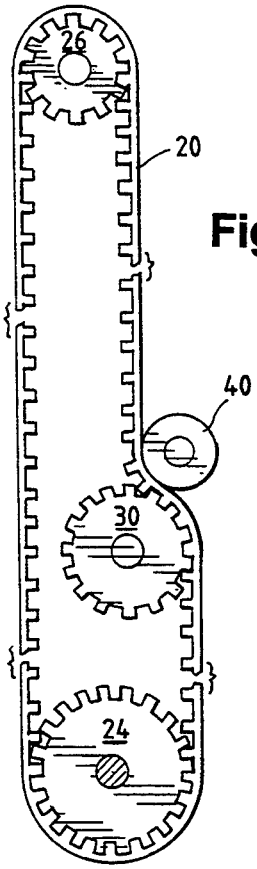
Fig. 2
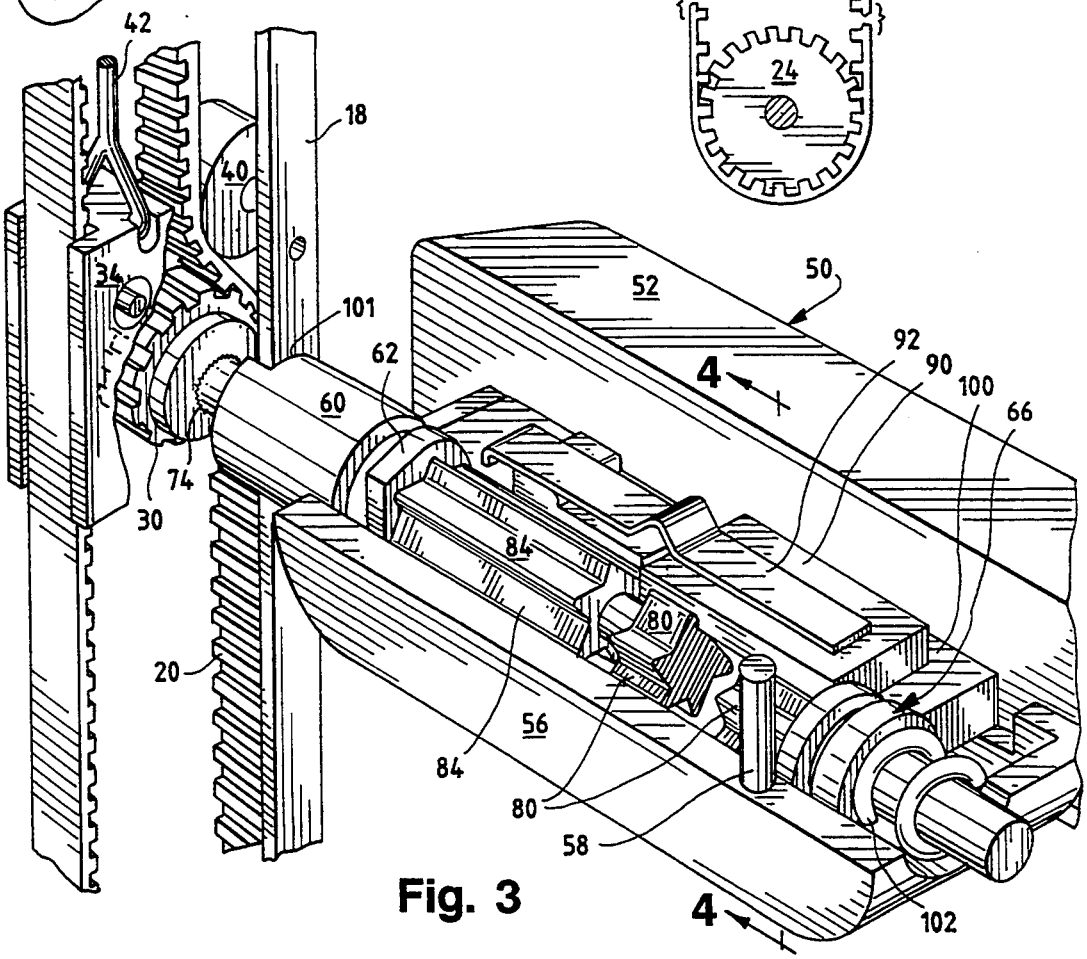
Fig. 3

MANUALLY OPERABLE SASH LIFT FOR MOTORIZED DOUBLE HUNG WINDOW

BACKGROUND OF THE INVENTION

1. Technical Field

The present invention is directed toward double hung windows, and more particularly toward double hung windows allowing both powered and manual operation.

2. Background Art

Conventionally, windows have been manually operated for opening and closing. However, in some applications, motorized operation of such windows is desired, not only to ease the task of opening and closing but also to allow for increasingly sophisticated types of automatic control. For example, windows can be operated responsive to weather sensors so as to automatically close if precipitation is detected. Further, homes can include controls for powered operation of all windows from a central location (or even by hand held remote controls). It is even possible to access such central controls through telephone line links.

While such powered operation has many advantages, however, it is nevertheless necessary to permit the windows to be operated manually in case of emergency or power outage or other problem with proper operation of the powered system. Still further, such manual operation must be simple enough to be readily accomplished by anyone, including, for example, a physically challenged individual required to open the window in an emergency.

Of course, it is still further necessary that the window sash and window frame in any installation be easily installed and maintained, including permitting easy removal of the sash from the frame if necessary to service the window. Still further, in double hung windows, it is desirable that there be an ability to tilt the window sash to allow easy access to the outside of the pane of the sash for washing.

The present invention is directed toward meeting the needs of double hung windows in such systems.

SUMMARY OF THE INVENTION

In one aspect of the present invention, an apparatus for powered movement of a window sash of a double hung window is provided including a drive belt along one side of the frame and a powered drive for controlling movement of the belt wherein the belt is secured to the sash and manually releasable to permit selective manual movement of the sash relative to the belt. In a preferred form of this aspect of the invention, a pulley is secured to the sash and engages the drive belt, whereby manual and powered control of movement is selected by selective control of the freedom of rotation of the pulley.

In another aspect of the present invention, an apparatus for controlling linear movement of a window sash is provided including a drive member such as a looped belt adjacent one side of the sash, a power drive such as an electric motor for the drive member, and a manually graspable sash lift associated with the sash for manually moving the sash. A locking member is carried with the sash and releasably secured to the drive member whereby a biasing force applied to the sash lift releases the locking member to allow movement of the sash and locking member relative to the drive member.

In one preferred form of the present invention, the locking member is a pulley carried with the sash and engaging the drive member. The pulley is disengageably secured against pivoting wherein biasing from the sash lift the releasing means disengages the securing means when a biasing force is applied to the sash lift.

In still another aspect of this preferred form of the present invention, a shaft is pivotally mounted to the sash and is axially biased outwardly toward engaging a spline connection on its end with the pulley. The sash lift is manually engageable to laterally move the shaft against the biasing force and out of engagement with the pulley so as to permit the sash to thereby be disconnected from the pulley as might be desired, for example, during maintenance.

In a still further preferred form of the present invention, two ratchets are provided to respectively secure the pulley against pivoting in either direction, and the sash lift when biased releases that ratchet which secures the pulley against pivoting in the direction required to allow the sash to move relative to the drive member in the direction biased. One ratchet has a first wheel with inclined teeth and a first pawl biased into engagement with the first wheel and the other ratchet has a second wheel with inclined teeth and a second pawl biased into engagement with the second wheel, and the sash lift is movable a limited amount in either the first or second directions in response to a manually applied biasing force to move a respective one of the pawls during such limited movement clear of the inclined teeth of its associated wheel.

In yet another aspect of the present invention, a recess is provided in the sash open toward the face of the sash and on the side of the sash adjacent the securing pulley through a substantially cylindrical opening. A housing for the ratchets is disposed in the sash recess and has an opening on the end adjacent the cylindrical opening. A bushing for the shaft is receivable in the sash cylindrical opening and includes an irregularly shaped flange receivable through the housing opening whereby twisting of the bushing axially secures it in the sash through engagement with the sash lift.

It is an object of the invention to provide a powered drive for opening and closing a double hung window which can also be easily operated manually whenever desired, whether as a necessity (during a power outage or other power failure) or just simply as a convenience.

It is another object of the invention to provide a manually operable powered drive for a double hung window which may be easily and inexpensively installed, reliably operated, and easily maintained over the long expected life of the drive.

It is still another object of the present invention to provide a drive for a double hung window which readily allows the sash of the window to be tilted out for washing and/or removed for any necessary maintenance to the sash or frame of the window.

BRIEF DESCRIPTION OF THE DRAWINGS

FIG. 1 is a perspective view of a motorized double hung window according to the present invention;

FIG. 2 is a side view, taken along line 2—2 of FIG. 1, showing a portion of the motorized drive;

FIG. 3 is a perspective view, with the sash broken away, showing the manual sash lift;

DESCRIPTION OF THE PREFERRED EMBODIMENT

Figure 4:
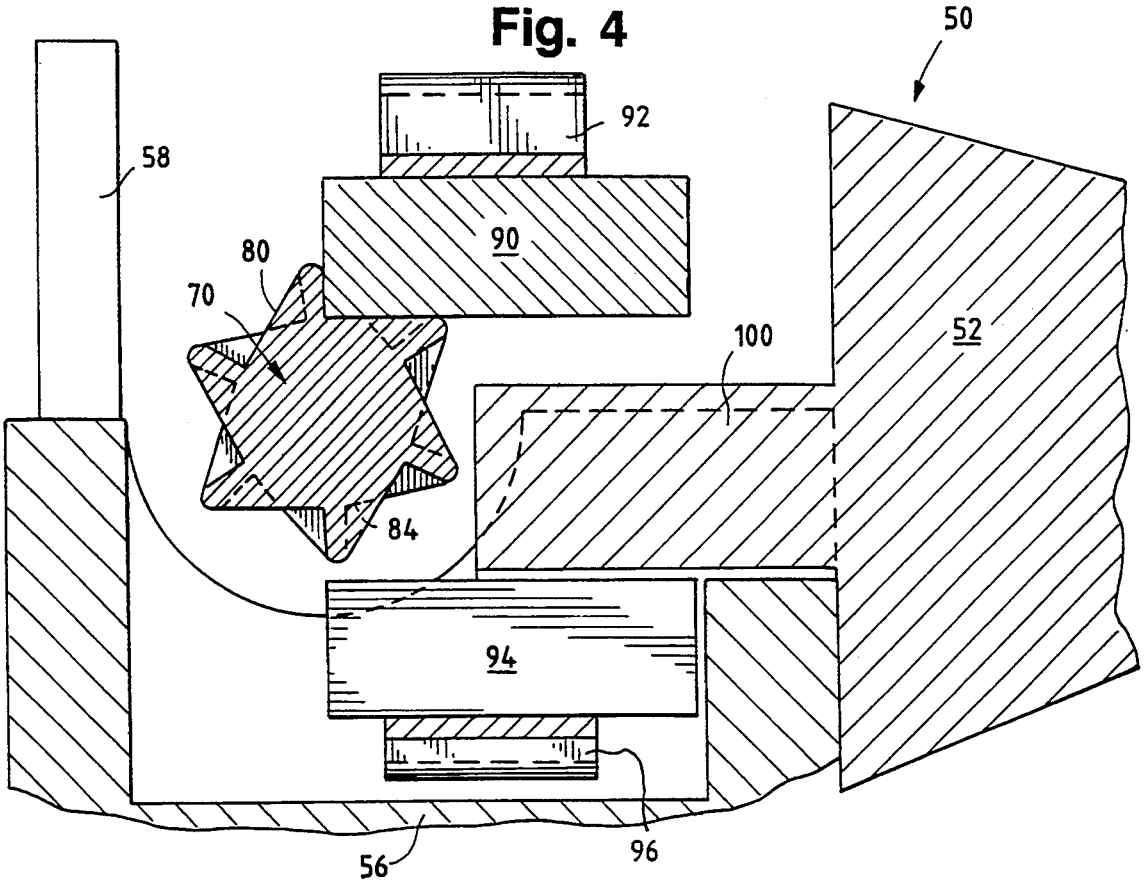
FIG. 4 is a cross-sectional view, taken along line 4—4, showing the sash lift of the present invention during downward biasing of the window.

A double hung window 10, including an upper sash 12 and a lower sash 14 and embodying the present invention is shown in FIG. 1. The window 10 is opened and closed by raising and lowering one of the sashes 12, 14 within the frame in a linear or planar direction. Typically, as in the window 10 shown, the lower sash 14 is the one which is raised to open the window 10 and lowered to close the window 10.

Disposed along one side of the window frame 16, preferably in a jamb liner 18 (see FIG. 3) is a timing belt 20 arranged in an endless loop about a drive pulley 24 at the bottom end and an idler or driven pulley 26 at the top end. The drive pulley 24 is rotatably driven by a power source such as an electric motor 28 (shown in phantom in FIG. 1 ). Control of the motor 28 can be accomplished by connection to a local switch or to a remote central control (operable, for example, by a central computer and/or a hand held remote control). When the motor 28 is not running, the timing belt 20 is effectively restrained from turning.

Further, once the present invention is understood, it should be recognized that a wide variety of types of belts could be used in accordance with the invention, although a toothed belt such as the timing belt 20 shown is a preferred form as it is not susceptible to slippage relative to the pulleys 24, 26. Still further, it will also be understood that a rack or other type of track could be used in place of the belt 20 to practice many of the principles of the invention disclosed herein, although an endless belt 20 such as shown is a preferred form as it allows for unrestricted manual and powered movement of the sash 14 without physical limitation.

A locking or securing pulley 30 engages the timing belt 20 along one side of the belt loop. The securing pulley 30 is rotatably mounted to a shoe 34 which is vertically movable along the side of the window frame 16 (the window 10 shown is a conventional double hung window in which the sashes move vertically, but it should be understood that many aspects of this invention could also be used with windows which slide horizontally). A freely rotatable tensioning pulley 40 is also mounted to the shoe 34 so that it engages the opposite side of the belt 20 in such a manner as to ensure an adequate driving connection between the belt 20 and the securing pulley 30.

A suitable counterbalancing weight, such as a block and tackle type sash balance, is also preferably secured to the shoe 34 by a cable 42 (see FIG. 3). Such weights, as are known, serve to balance the weight of the sash 14 so as to reduce the amount of force required to raise the sash 14. As a result, although the gearing of the motor connection to the drive pulley 24 as well as the power of the motor 28 may be varied depending on the installation, the need to match such design parameters to the sash of a particular installation can be minimized and even effectively eliminated. Still further, such balancing on both sides of the sash 14 can allow a window 10 to be installed with the drive on only one side as described herein. However, it should be recognized to be within the scope of the present invention to use a synchronized drive on both sides of the sash 14 (such a dual drive might be appropriate, for example, for particularly wide windows in which case a drive force applied to only one side might tend to twist the window and cause binding).

As best seen in FIGS. 2 and 3, movement of the belt 20 will carry the securing pulley 30 if the pulley 30 is fixed against rotation, and by contrast the securing pulley 30 (and associated tensioning pulley 40) may move up and down the belt 20 if the pulley 30 is free to rotate. Accordingly, as will be understood from the below description, the belt 20 may be driven with the securing pulley 30 restrained from pivoting to move the sash 14. Further, by releasing the securing pulley 30 to permit rotation in one direction or the other as further described below, the sash 14 may be freely moved up or down independent of the operation of the belt 20.

Positioning of the powered drive can be controlled in any suitable manner. Since the sash 14 is not fixed in a specific position relative to the electric motor 28 (due to possible manual operation), one suitable control would be a circuit overload trip in which the motor 28 would shut down under heavy loading as would occur at the end of the range of travel of the sash 14. Such a configuration would, of course, also protect against damage should the sash 14 encounter any obstruction in an intermediate position. Still other controls could, of course, be used, including, for example, use of position switches or a servo motor system in which the limits of motion of the sash 14 would be re-learned whenever used.

A sash lift 50 including a handle portion 52 and a housing 56 is received in a recess in the sash 14 such as a cavity milled into the side of the sash 14 (not shown in FIG. 3). The housing 56 may be mounted in the sash recess through an open portion facing the interior side of the dwelling in which the window 10 is installed. Once fully installed, however, the handle portion 52 will substantially conceal the housing 56 (see FIG. 1) so as to provide an aesthetically pleasing appearance.

Figure 5:
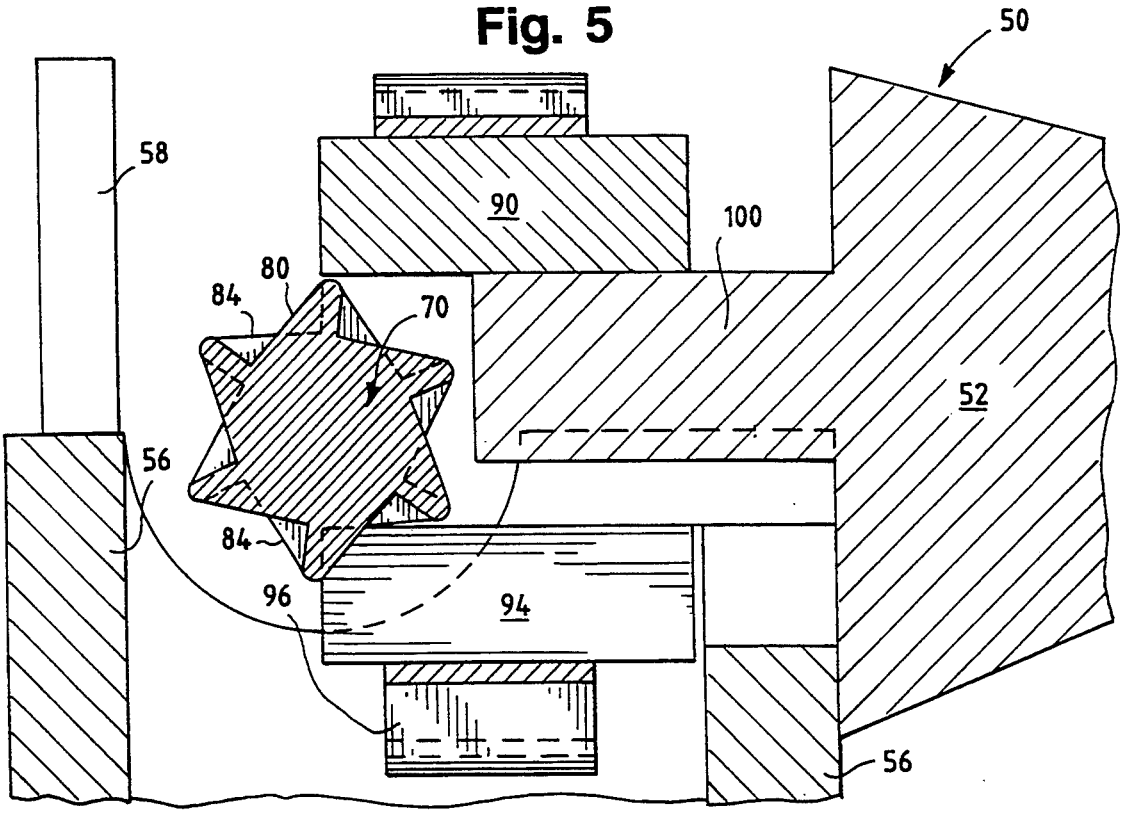
FIG. 5 is a cross-sectional view similar to FIG. 4 showing the sash lift of the present invention during upward biasing of the window.

Only the lower half of the housing 56 is shown in FIGS. 3–5. The upper half of the housing 56 is preferably suitably mated to the lower half during assembly before mounting in the sash recess. As shown in FIGS. 3–5, suitable means such as an alignment pin or mounting post 58 may be used to align and secure the two halves of the housing 56 together.

The sash 14 also preferably includes a cylindrical opening between the recess and the side of the sash 14 adjacent the jamb liner 18. A cylindrical boss 60 is inserted into the cylindrical opening and includes a keyed D-shaped flange 62 received through an annular opening at the end of the housing 56.

A second boss 66 is suitably supported at the opposite end of the housing 56. A ratchet shaft 70 extends through and is rotationally supported by the bosses 60, 66. The shaft 70 includes a splined end connector 74 which, when the sash lift 50 is fully installed with the sash 14 in the frame 16, mates with a similar connector in the securing pulley 30 so as to fix the securing pulley 30 and ratchet shaft 70 for rotation together. Still other connectors, such as a TORX connector, could alternatively be used within the scope of the present invention, with the desired characteristic of the preferred embodiment of the present invention being that the connector fix the shaft 70 and pulley 30 for rotation together while also allowing axial movement of the shaft 70 into and out of engagement with the pulley 30. Still further, it should be recognized that this connection at the corner of the sash 14 can easily function as a pivot if the window is otherwise desired to be configured for tilt and wash operation.

The ratchet shaft 70 includes axially spaced and oppositely facing inclined teeth 80, 84 which are preferably integrally formed on the shaft 70. A first dog or pawl 90 is axially aligned with and suitably biased down (as by the leaf spring 92 shown) toward engagement with one set of inclined teeth 80. A second dog or pawl 94 is axially aligned with and suitably biased up (as by the leaf spring 96) toward engagement with the other set of inclined teeth 84. As a result, when the two pawls 90, 94 both engage the inclined teeth 80, 84, the shaft 70 is fixed against rotation.

The handle portion 52 includes a flanged portion 100 extending into the housing 56 and positioned between the pawls 90, 94. Further, the handle portion 52 is suitably secured to permit a limited amount of motion up, down, and laterally relative to the housing 56 and sash 14 when manually biased in one of those directions.

The flanged portion 100 also includes a suitable tab (not shown) which may be aligned with the boss flange 62 to secure the boss 60 in the sash 14. Specifically, the flat side of the boss flange 62 when axially mounted in the sash 14 clears the tab of the flanged portion 100, and the boss 60 is then turned (as by use of a suitable tool in the slot 101 provided in the end of the boss 60) to move the flat side away from the tab. When so oriented, a cylindrical portion of the flange 62 will abut the tab to secure the boss 60 against axial movement back out the cylindrical opening in the sash 14. Similarly, the end of the boss 60 extending into the housing 56 will assist in holding the housing 56 in the sash recess.

A compression spring 102 (see FIG. 3) between the end of the housing 56 and the boss 66 biases the shaft 70 (through the abutment of the boss 66 with the end of the ratchet teeth 80) into its splined connection with the securing pulley 30.

Operation of the above described embodiment of the present invention is thus as follows. Once this operation is understood, it should become apparent that still other structures for releasably limiting rotation of the securing pulley 30 could be used within the scope of the present invention.

During normal powered operation, the handle portion 52 is not manipulated and thus the leaf springs 92, 96 bias both pawls 90, 94 into engagement with the associated inclined teeth 80, 84 of the ratchet shaft 70. Accordingly, the shaft 70 and securing pulley 30 are secured against rotation in either direction and the sash 14 is thereby fixed to the belt 20. The motor 28 may thus be controlled to move the belt 20 and thus the sash 14, or if not powered will effectively hold the sash 14 in position (whether fully open, fully closed, or an intermediate position therebetween).

If it is desired to manually lower the sash 14, a person would grasp the handle portion 52 of the sash lift 50 and pull down. Such a force would first move the handle portion 52 and bottom pawl 94 down (against the biasing force of the leaf spring 96) a limited amount to unseat the pawl 94 from the inclined teeth 84 as shown in FIG. 4. Accordingly, the ratchet shaft 70 will be able to pivot counterclockwise as viewed in FIG. 4 and, as should be apparent from FIG. 3, such counterclockwise pivoting of the connected securing pulley 30 would permit the pulley 30 to freely roll down the belt 20 as the sash 14 moves down under continued downward force applied by the person closing the sash 14. Of course, the opposite inclination of the other set of inclined teeth 80 allow the shaft 70 to rotate counterclockwise notwithstanding the engagement of their pawl 90. Once the sash 14 is in the desired position, the person would release the handle portion 52 and the leaf spring 96 would return the pawl 94 into engagement with the teeth 84 to again secure the shaft 70 and securing pulley 30 against rotation, effectively locking the sash 14 to the belt 20 once again.

Alternatively, if it is desired to manually raise the sash 14, a person would grasp the handle portion 52 of the sash lift 50 and pull up. Such a force would first move the handle portion 52 and top pawl 90 up (against the biasing force of the leaf spring 92) a limited amount to unseat the pawl 90 from the inclined teeth 80 as shown in FIG. 5. Accordingly, the ratchet shaft 70 will be able to pivot clockwise as viewed in FIG. 5 and, as should be apparent from FIG. 3, such clockwise pivoting of the connected securing pulley 30 would permit the pulley 30 to freely roll up the belt 20 as the sash 14 moves up under continued upward force applied by the person opening the sash 14. Of course, the opposite inclination of the other set of inclined teeth 84 allow the shaft 70 to rotate clockwise notwithstanding the engagement of their pawl 94. However, should the person's grip on the handle portion 52 slip, the other teeth 84 and pawl 94 will prevent the sash 14 from falling back down.

In addition to the above operational advantages, the above described embodiment allows for easy installation as well as easy removal should it become necessary at some later time for maintenance, etc.

Specifically, installation in the sash 14 is easily accomplished as follows. The sash lift 50 and various internal components (such as the second boss 66, pawls 90, 94, leaf springs 92, 96, and compression spring 102, but not the shaft 70) are assembled to the housing 56. The housing 56 is then placed in the sash recess, and the ratchet shaft 70 is extended through the cylindrical sash opening from the side into the housing 56 (the ends of the pawls 90, 94 may be tapered to assist in fitting the shaft 70 between them). The keyed boss 60 is then inserted into the sash cylindrical opening and over the end of the shaft 70, and is then twisted to secure it to the sash lift flanged portion 100 as previously described. Once this assembly is completed, the handle portion 52 of the sash lift 50 may be pushed laterally against the force of the compression spring 102 as previously described to retract the end of the shaft 70 into the sash 14 to thereby allow the sash 14 to be moved into the frame 16. The sash lift handle portion 52 may thereafter be released and, when the sash 14 is moved into position aligning the shaft 70 with the securing pulley 30, the compression spring 102 will extend the shaft 70 into its previously described splined connection therewith.

Further, if it is thereafter necessary to remove the sash 14 for maintenance, the handle portion 52 of the sash lift 50 may again be biased laterally away from the window frame 16. When this is done, the handle flanged portion 100 pushes against the boss 66 and compression spring 102 to move the shaft 70 away from the frame 16 and free from its connection to the securing gear 30, thereby freeing the sash 14 at that corner from the frame 16.

It should now be apparent that the above described invention for controlling opening and closing of a double hung window which can be conveniently operated through use of a powered drive, while also being easily operated manually whenever desired. Further, this structure may be easily and inexpensively installed, reliably operated, and easily accessed for maintenance over the long expected life of the drive. Still further, the above described invention is readily usable in virtually any desired double hung window configuration including, for example, windows in which the sash may be tilted out for washing.

Still other aspects, objects, and advantages of the present invention can be obtained from a study of the specification, the drawings, and the appended claims.

I claim:

1. An apparatus for controlling a first sash movable along a substantially straight path relative to a frame for opening and closing an opening defined by the frame, said apparatus comprising:

a drive belt along one side of the frame;

powered means for moving said drive belt;

means for releasably securing said drive belt to a first sash; and manually graspable means associated with the first sash for manually moving said first sash in response to a manual biasing force applied to said graspable moving means; and means connecting said moving means to said securing means whereby said securing means is released only during application of said manual biasing force to said moving means.

2. The apparatus of claim 1, wherein:

said drive belt is a timing belt configured in an endless loop; and said powered moving means comprises an electric motor fixed with respect to said frame and driving a drive pulley engaging said timing belt.

3. The apparatus of claim 1, wherein said drive belt is effectively restrained from turning when said powered means is not operating to move said drive belt.

4. An apparatus for controlling a first sash movable along a substantially straight path relative to a frame for opening and closing an opening defined by the frame, said apparatus comprising:

a drive belt along one side of the frame;

powered means for moving said drive belt, said drive belt being effectively restrained from turning when said powered means is not operating to move said drive belt;

means for releasably securing said drive belt to a first sash including a securing pulley secured to the first sash and engaging the drive belt, a ratchet assembly secured to said first sash and including a first ratchet for preventing pivoting of said securing pulley in one direction to prevent movement of said secured first sash relative to said drive belt in a first direction, and a second ratchet for preventing pivoting of said securing pulley in the other direction to prevent movement of said secured first sash relative to said drive belt in a second opposite direction; and manually graspable means associated with the first sash for manually moving said first sash, said graspable moving means disengaging said first ratchet when manually biased toward moving the first sash in the first direction and disengaging said second ratchet when biased toward moving the first sash in the second direction.

5. The apparatus of claim 4, further comprising a tensioning pulley secured to the first sash and engaging said drive belt to maintain said securing pulley in engagement therewith.

6. The apparatus of claim 5, wherein:

said drive belt is a timing belt configured in an endless loop; and said powered moving means comprises an electric motor fixed with respect to said frame and driving a drive pulley engaging said timing belt.

7. The apparatus of claim 4, wherein:

said first ratchet includes a first wheel with inclined teeth and a first pawl biased into engagement with said first wheel;

said second ratchet includes a second wheel with inclined teeth and a second pawl biased into engagement with said second wheel; and said graspable moving means when manually biased toward said first direction disengages said first pawl from said first wheel and when manually biased toward said second direction disengages said second pawl from said second wheel.

8. The apparatus of claim 7, wherein said graspable moving means comprises a handle movable a limited amount in either the first or second directions in response to a manually applied biasing force, and said handle biases against a respective one of said pawls during such limited movement to move said respective pawl clear of its associated wheel.

9. The apparatus of claim 7, wherein said first and second ratchet wheels are pivotally mounted with respect to said first sash and fixed in axial alignment with said securing pulley.

10. An apparatus for controlling a first sash movable along a substantially straight path relative to a frame for opening and closing an opening defined by the frame, said apparatus comprising:

a drive belt along one side of the frame;

powered means for moving said drive belt;

means for releasably securing said drive belt to a first sash; and manually graspable means associated with the first sash for manually moving said first sash, said graspable moving means releasing said securing means when manually biased to move the first sash;

a securing pulley engaging the drive belt;

a shaft pivotally mounted to the sash, means for biasing one end of said shaft from a side of the sash, said shaft one end including a spline connection to the securing pulley and said securing means releasably securing said shaft against pivoting; and means for selectively retracting said shaft against the force of the biasing means to selectively disconnect said shaft from said securing pulley.

11. The apparatus of claim 10, wherein said graspable means is movable laterally to the direction of motion of the sash and is secured to the shaft to retract said shaft against the force of the biasing means when moved laterally.

12. The apparatus of claim 10, further comprising:

a housing recess in said sash, said housing recess being open on the side of the sash adjacent the securing pulley through a substantially cylindrical opening;

a housing in the sash recess and having an opening on the end adjacent the cylindrical opening; and a bushing for supporting the shaft and receivable in said sash cylindrical opening, said bushing further having a flange receivable through the housing opening whereby twisting of said bushing misaligns the flange with an element secured to said housing whereby said flange and said element cooperate to secure said bushing in said cylindrical opening.

13. The apparatus of claim 12, wherein said bushing flange is substantially cylindrical except for a flat portion along one side.

14. An apparatus for controlling a first sash movable along a substantially straight path relative to a frame for opening and closing an opening defined by the frame, said apparatus comprising:

a drive belt along one side of the frame;

powered means for moving said drive belt;

means for releasably securing said drive belt to a first sash; and manually graspable means associated with the first sash for manually moving said first sash, said graspable moving means releasing said securing means when manually biased to move the first sash; and a counterweight connected to the sash and applying a force thereto opposite the force of gravity on the sash.

15. An apparatus for controlling a first sash movable along a substantially straight path relative to a frame for opening and closing an opening defined by the frame, said apparatus comprising:

a controllable, motor driven belt supportable in an endless loop adjacent one side of a first sash;

a shaft rotatably fixed to the sash and secured to a pulley engaging the drive belt;

a first ratchet for preventing pivoting of said shaft in one direction to prevent movement of said pulley relative to said belt in a first direction;

a second ratchet for preventing pivoting of said shaft in the other direction to prevent movement of said pulley relative to said drive belt in a second opposite direction;

a manually graspable sash lift securable to the first sash for selectively moving the first sash in either the first or second direction; and means for connecting said sash lift to said first and second ratchets, whereby said sash lift when manually biased in the first direction disengages the first ratchet to allow pivoting of the shaft in said one direction and when manually biased in the second direction disengages the second ratchet to allow pivoting of the shaft in said other direction.

16. The apparatus of claim 15, further comprising a tensioning pulley securable to the first sash, said tensioning pulley and shaft pulley engaging said belt on opposite sides to maintain said securing pulley in engagement therewith.

17. The apparatus of claim 15, wherein said belt has teeth and is looped about a pair of belt pulleys rotatably mountable with respect to a frame, one of said belt pulleys being selectively drivable by an electric motor fixable with respect to said frame.

18. The apparatus of claim 15, wherein:

said first ratchet includes a first wheel with inclined teeth and a first pawl biased into engagement with said first wheel;

said second ratchet includes a second wheel with inclined teeth and a second pawl biased into engagement with said second wheel; and said sash lift when manually biased toward said first direction disengages said first pawl from said first wheel and when manually biased toward said second direction disengages said second pawl from said second wheel.

19. The apparatus of claim 18, wherein said sash lift is movable a limited amount in either the first or second directions in response to a manually applied biasing force, and said sash lift biases against a respective one of said pawls during such limited movement to move said respective pawl clear of the inclined teeth of its associated wheel.

20. The apparatus of claim 18, wherein said first and second pawls are biased into engagement with their associated wheels by first and second leaf springs respectively.

21. The apparatus of claim 15, further comprising:

means for biasing one end of said shaft from a side of the sash, said shaft one end including a spline connection to the belt engaging pulley; and means for selectively retracting said shaft against the force of the biasing means to selectively disconnect said shaft from said securing pulley.

22. The apparatus of claim 21, wherein said sash lift is connected to said shaft whereby manual biasing of the sash lift laterally to the direction of motion of the sash retracts said shaft against the force of the biasing means.

23. The apparatus of claim 21, further comprising:

a housing recess in said sash, said housing recess being open on the side of the sash adjacent the belt engaging pulley through a substantially cylindrical opening;

a housing in the sash recess and having an opening on the end adjacent the cylindrical opening, said housing enclosing said first and second ratchets; and a bushing for supporting the shaft and receivable in said sash cylindrical opening, said bushing further having a flange receivable through the housing opening whereby twisting of said bushing misaligns the flange with an element secured to the housing whereby said flange and said element cooperate to secure said bushing in said cylindrical opening.

24. The apparatus of claim 23, wherein said bushing flange is substantially cylindrical except for a flat portion along one side.

25. The apparatus of claim 15, further comprising a counterweight connected to the shaft and applying a force thereto opposite the force of gravity on the sash.

26. An apparatus for controlling movement of a sash supported for linear movement with respect to a frame, said apparatus comprising:

a drive member adjacent one side of a sash;

means for selectively driving said drive member substantially along to the path of movement of the sash;

a locking member carried with the sash and releasably secured to the drive member;

a sash lift secured to the sash and manually engageable to bias the sash toward movement; and means for releasing said locking member for movement relative to said drive member only during application of a biasing force to the sash lift.

27. An apparatus for controlling movement of a sash supported for linear movement with respect to a frame, said apparatus comprising:

a drive member adjacent one side of a sash;

means for selectively driving said drive member substantially along to the path of movement of the sash;

a locking member carried with the sash and releasably secured to the drive member;

a sash lift secured to the sash and manually engageable to bias the sash toward movement; and means for releasing said locking member for movement relative to said drive member in response to a biasing force applied to the sash lift;

wherein said locking member includes a pulley carried with said sash and engaging said drive member; and disengageable means for securing said pulley against pivoting wherein said releasing means disengages said securing means when a biasing force is applied to the sash lift.

28. The apparatus of claim 27, wherein said driving means is an electric motor and said drive member is a portion of a looped belt driven by said motor.

29. The apparatus of claim 28, further comprising a jamb liner associated with the frame along one side of the sash, said belt being disposed in said liner.

30. The apparatus of claim 28, further comprising a tensioning pulley securable to the sash, said tensioning pulley and shaft pulley engaging said belt on opposite sides to maintain said securing pulley in engagement therewith.

31. The apparatus of claim 27, wherein:

said securing means comprises first means for securing said pulley against pivoting in one direction and second means for securing said pulley against pivoting in the other direction; and said releasing means disengages only said first securing means when biased to move the sash in a first direction and disengages only said second securing means when biased to move the sash in a second opposite direction.

32. The apparatus of claim 31, wherein:

said first securing means comprises a first ratchet having a first wheel with inclined teeth and a first pawl biased into engagement with said first wheel; and said second securing means comprises a second ratchet having a second wheel with inclined teeth and a second pawl biased into engagement with said second wheel.

33. The apparatus of claim 32, wherein said first and second pawls are biased into engagement with their associated wheels by first and second leaf springs respectively.

34. The apparatus of claim 32, wherein said sash lift when manually biased toward said first direction disengages said first pawl from said first wheel and when manually biased toward said second direction disengages said second pawl from said second wheel.

35. The apparatus of claim 34, wherein said sash lift is movable a limited amount in either the first or second directions in response to a manually applied biasing force, and said sash lift biases against a respective one of said pawls during such limited movement to move said respective pawl clear of the inclined teeth of its associated wheel.

36. The apparatus of claim 27, further comprising:

a shaft pivotally mounted to the sash, means for biasing one end of said shaft from a side of the sash, said shaft one end including a spline connection to the drive member engaging pulley; and means for selectively retracting said shaft against the force of the biasing means to selectively disconnect said shaft from said drive member engaging pulley.

37. The apparatus of claim 36, wherein said sash lift is connected to said shaft whereby manual biasing of the sash lift laterally to the direction of motion of the sash retracts said shaft against the force of the biasing means.

38. The apparatus of claim 36, further comprising:

a housing recess in said sash, said housing recess being open on the side of the sash adjacent the drive member engaging pulley through a substantially cylindrical opening;

a housing in the sash recess and having an opening on the end adjacent the cylindrical opening; and a bushing for supporting the shaft and receivable in said sash cylindrical opening, said bushing further having a flange receivable through the housing opening whereby twisting of said bushing misaligns the flange with an element secured to the housing whereby said flange and said element cooperate to secure said bushing in said cylindrical opening.

39. The apparatus of claim 38, wherein said bushing flange is substantially cylindrical except for a flat portion along one side, and twisting of said bushing to secure it in the cylindrical opening misaligns the flat portion from the element.

40. The apparatus of claim 38, further comprising:

a handle portion of the sash lift;

a first ratchet having a first wheel rotatably secured to said shaft with inclined teeth and a first pawl biased into engagement with said first wheel to secure the shaft against pivoting in one direction; and a second ratchet having a second wheel rotatably secured to said shaft with inclined teeth and a second pawl biased into engagement with said second wheel to secure the shaft against pivoting in the other direction;

wherein said housing encloses said first and second ratchets and is open toward one face of the sash to permit connection of said sash lift handle portion to said sash.

41. An apparatus for powered movement of a sash of a double hung window, said sash being movable along a substantially straight path relative to a frame for opening and closing the window, said apparatus comprising:

a drive belt along one side of the frame;

powered means for controlling movement of said belt;

means for releasably securing said drive belt to the sash;

handle means securable to the sash and manually engageable for application of a manual force biasing the sash toward movement in either direction along the straight path; and means for selectively releasing said securing means to permit manual movement of the sash relative to the belt in response to the manual biasing force applied to the handle means.

42. The apparatus of claim 41, wherein:

said securing means is a securing pulley secured to the first sash and engaging the drive belt; and said releasing means are manually operable to selectively control the freedom of rotation of said securing pulley.

* * * * *